US005316450A

United States Patent [19]

Kast

[11] Patent Number: 5,316,450

[45] Date of Patent: May 31, 1994

[54] FIXED CAM VARIABLE DELIVERY VANE PUMP

[75] Inventor: Howard B. Kast, West Chester, Ohio

[73] Assignee: General Electric Company, Cincinnati, Ohio

[21] Appl. No.: 17,158

[22] Filed: Feb. 12, 1993

[51] Int. Cl.[5] ..... F04B 49/00

[52] U.S. Cl. ..... 417/295; 417/310; 417/440

[58] Field of Search ..... 417/295, 296, 310, 440, 417/441

[56] References Cited

U.S. PATENT DOCUMENTS

| | | | |
|---|---|---|---|
| 3,642,387 | 2/1972 | Sundberg | 418/16 |
| 3,645,652 | 2/1972 | Cygnor | 418/31 |
| 3,650,642 | 3/1972 | Cygnor et al. | 418/26 |
| 3,730,653 | 5/1973 | Drutchas et al. | 418/32 |
| 3,744,939 | 7/1973 | Grennan et al. | 418/30 |
| 3,908,360 | 9/1975 | Meyer et al. | 60/39.28 |
| 4,222,712 | 9/1980 | Huber et al. | 417/204 |
| 4,406,599 | 9/1983 | Stephan | 418/22 |
| 4,439,117 | 3/1984 | Bunger | 418/22 |
| 4,445,830 | 5/1984 | Woodruff | 418/22 |
| 4,890,986 | 1/1990 | Taguchi et al. | 417/295 |
| 4,892,466 | 1/1990 | Taguchi et al. | 417/295 |
| 5,026,257 | 6/1991 | Aihara et al. | 417/295 |
| 5,030,066 | 7/1991 | Aihara et al. | 417/295 |
| 5,125,804 | 6/1992 | Akaike et al. | 417/295 |

*Primary Examiner*—Richard A. Bertsch
*Assistant Examiner*—Alfred Basichas
*Attorney, Agent, or Firm*—Jerome C. Squillaro; Bernard E. Shay

[57] ABSTRACT

The discharge flow from a rotary vane pump is metered by directing a portion of the pump discharge back into the pump inlet area. A servo controlled actuator apportions the relative amounts of inlet fluid and returns fluid which enters the vane cavities. This arrangement allows for the use of a fixed cam which provides improved pump performance as compared to comparable movable cam pump designs.

8 Claims, 6 Drawing Sheets

FIXED CAM VARIABLE DELIVERY VANE PUMP

BACKGROUND OF THE INVENTION

1. Field of the Invention

The present invention relates in general to rotary vane pumps such as engine fuel pumps and actuator pumps and relates in particular to such pumps which vary their discharge flow by controllably metering the filling action of a fluid during the intake portion of vane cavity rotation.

2. Description of Prior Developments

Variable displacement pumps are typically more efficient than fixed displacement pumps controlled by bypass valves. Unfortunately, inefficiencies associated with prior variable displacement pumps have caused heating of the fluid as it is being pumped. Such heating is unacceptable in many advanced engine control systems such as those used in aircraft applications.

Although variable displacement piston pumps are commonly used in engine and aircraft hydraulic systems, vane pumps are generally more desirable for fuel applications since they are more contamination tolerant. Variable displacement vane fuel pumps generally require moving a cam to vary the pump displacement but this causes complexity in pump design and produces losses due to considerable leakage.

Accordingly, a need exists for an efficient, low loss, low leakage, variable delivery, positive displacement pump which embodies a relatively simple design.

A further need exists for a fuel pump of the variable delivery vane variety which is resistant to leakage and which does not require the use of a moving cam for varying the pump displacement or pump discharge flow.

SUMMARY OF THE INVENTION

The present invention has been developed to fulfill the needs noted above and therefore has as an object the provision of a variable delivery vane pump having a fixed cam which defines, in part, the intake and discharge cavities of the pump.

Briefly, the invention is directed to a variable delivery vane pump which operates with a normal pump discharge action but with a controllable, modified filling action during the intake portion of vane cavity rotation. The pump can function as a standard fixed displacement pump if all flow into the intake of the vane cavity is introduced from an external inlet to the pump. In this case, normal fuel pump flow occurs.

However, by redirecting all or a portion of the discharge from the pump back into the intake of the vane cavity in accordance with the invention, the pump discharge may be varied. If the vane cavities are completely filled from the redirected discharge of the pump, no net flow results and a "motor" action occurs during the filling portion of vane cavity rotation.

In effect, the pressurized pump discharge re-enters the vane cavities as they are increasing in volume so that the pump acts as a motor during a portion of its rotation. The net effect, at zero pump delivery (no external pump discharge), is that the pumping torque and motor torque applied to the pumping vanes are theoretically equal and opposite, thus requiring input power only for losses and friction. This provides for efficient pump operation.

Variable discharge flow is achieved by apportioning, metering and varying the amounts of inlet flow and redirected discharge flow into the pump inlet port. This is achieved by varying the inlet port length and inlet port area over which the inlet port to the vane cavities is respectively open to inlet flow pressure and to discharge flow pressure.

For example, if the inlet port is divided so that equal amounts of inlet flow and discharge flow enter the vane cavity during its intake portion of rotation, the net discharge flow from the pump will be about one-half of the maximum full discharge flow from the pump. That is, half of the flow which would normally be discharged from the pump is returned to the pump inlet so that only the remaining half of the pump discharge is allowed to exit the pump. Of course, any apportionment between zero and 100 percent external discharge is possible in accordance with the invention.

The aforementioned objects, features and advantages of the invention will, in part, be pointed out with particularity, and will, in part, become obvious from the following more detailed description, of the invention, taken in conjunction with the accompanying drawings, which form an integral part thereof.

BRIEF DESCRIPTION OF THE DRAWINGS

In the drawings.

In the various figures of the drawing, like reference characters designate like parts.

DETAILED DESCRIPTION OF THE PREFERRED EMBODIMENTS

Figure 1:
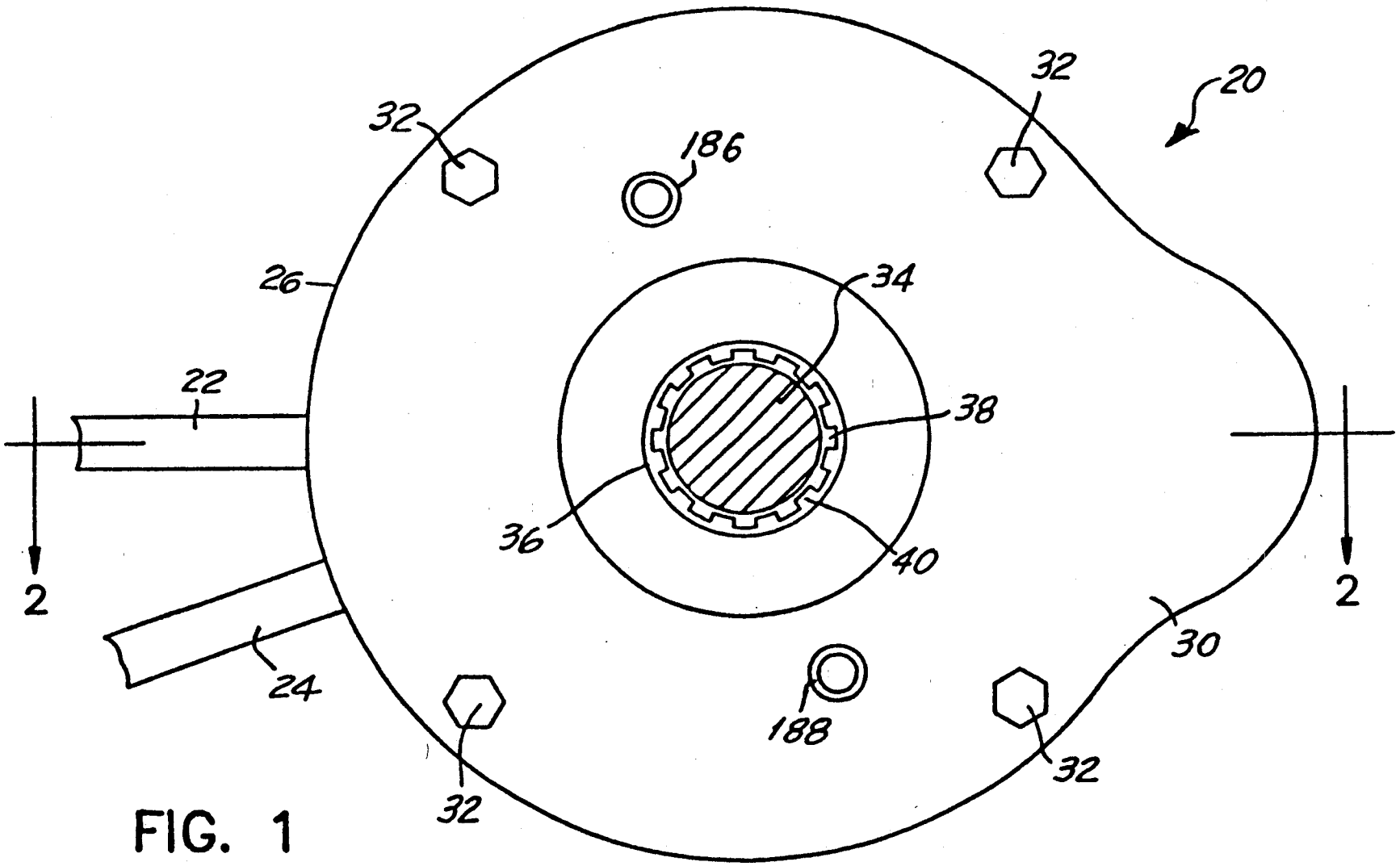
FIG. 1 is a bottom plan view of a fixed cam variable displacement vane pump constructed in accordance with the invention.

The present invention will now be described in conjunction with the drawings, beginning with FIGS. 1 and 2 which show a fixed cam variable delivery vane pump 20 having a low pressure inlet 22 and a high pressure outlet 24.

Pump 20 includes an external housing assembly 26 formed of an upper cup-shaped housing member 28 and a lower housing member 30. The housing members, which may be formed from a metal such as aluminum, may be secured together by bolts 32. A small axial circumferential clearance 33 may be provided between the housing members 28,30 to ensure the proper application of axial clamping force to the components mounted within the housing members. A drive shaft 34 extends through an opening 36 formed through the lower housing member 30. Drive shaft 34 is formed with splines 38 for engaging splines 40 on rotor 42.

Figure 2:
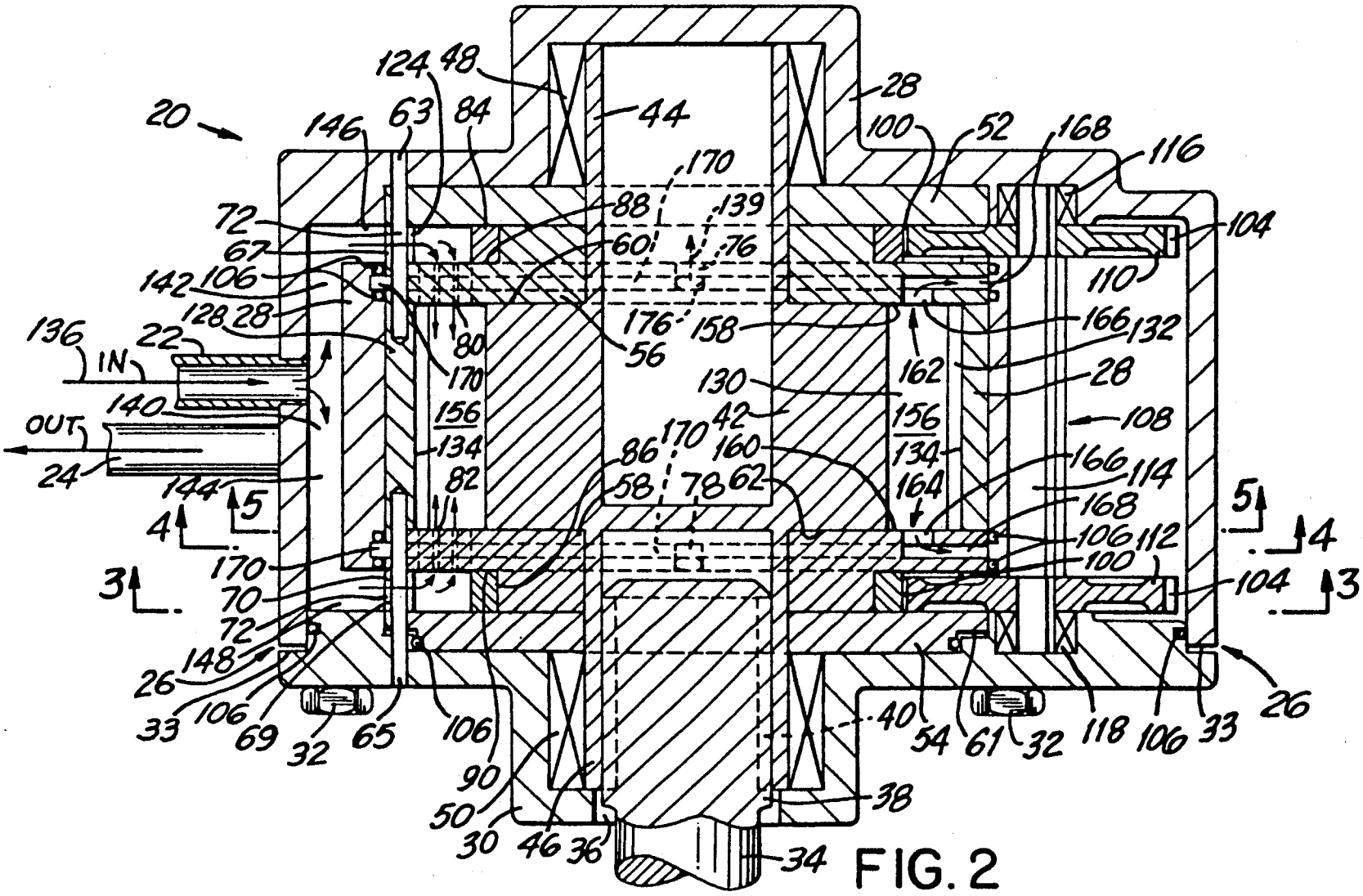
FIG. 2 is a central view in axial section of the pump of FIG. 1 as taken along line 2—2 thereof.

As shown in FIG. 2, rotor 42 includes a pair of upper and lower axially extending cylindrical rotor shafts 44,46 rotatably mounted within housing assembly 26 by an upper bearing assembly 48 and a lower bearing assembly 50. As will be noted from the following description, pump 20 is substantially symmetrical with respect to its upper and lower internal pumping components and flow paths.

A pair of upper and lower annular rotor end plates 52,54 is seated within complementary recesses formed in the upper and lower housing members 28,30. The rotor end plates are typically formed of a hard wear-resistant material. As seen in FIG. 2, additional axial clearances 61 may be provided to ensure proper clamping between the rotor end plate 54 and the lower housing member 30.

Upper and lower annular port plates 56,58 are axially interposed between the rotor end plates 52,54 and upper and lower radial shoulders 60,62 located on the rotor 42 at the base of each respective cylindrical rotor shaft 44,46. The upper and lower port plates are axially clamped to and supported by fixed cam 128.

A pair of upper and lower locating pins 63,65 extend axially through the upper and lower housing members 28,30, the upper and lower rotor end plates 52,54, the upper and lower port plates 56,58 and into the fixed cam 128. The locating pins prevent relative rotation between the pinned components. An opening 67,69 in ,the port plates 56,58 is formed at each locating pin for providing a flowpath around each pin.

A small radial clearance is provided between the rotor end plates and the port plates and rotor shafts. A small axial clearance is provided between the rotor shoulders 60,62 and the port plates. These radial and axial clearances provide for free relative movement between the respective confronting surfaces of these components.

Figure 3:
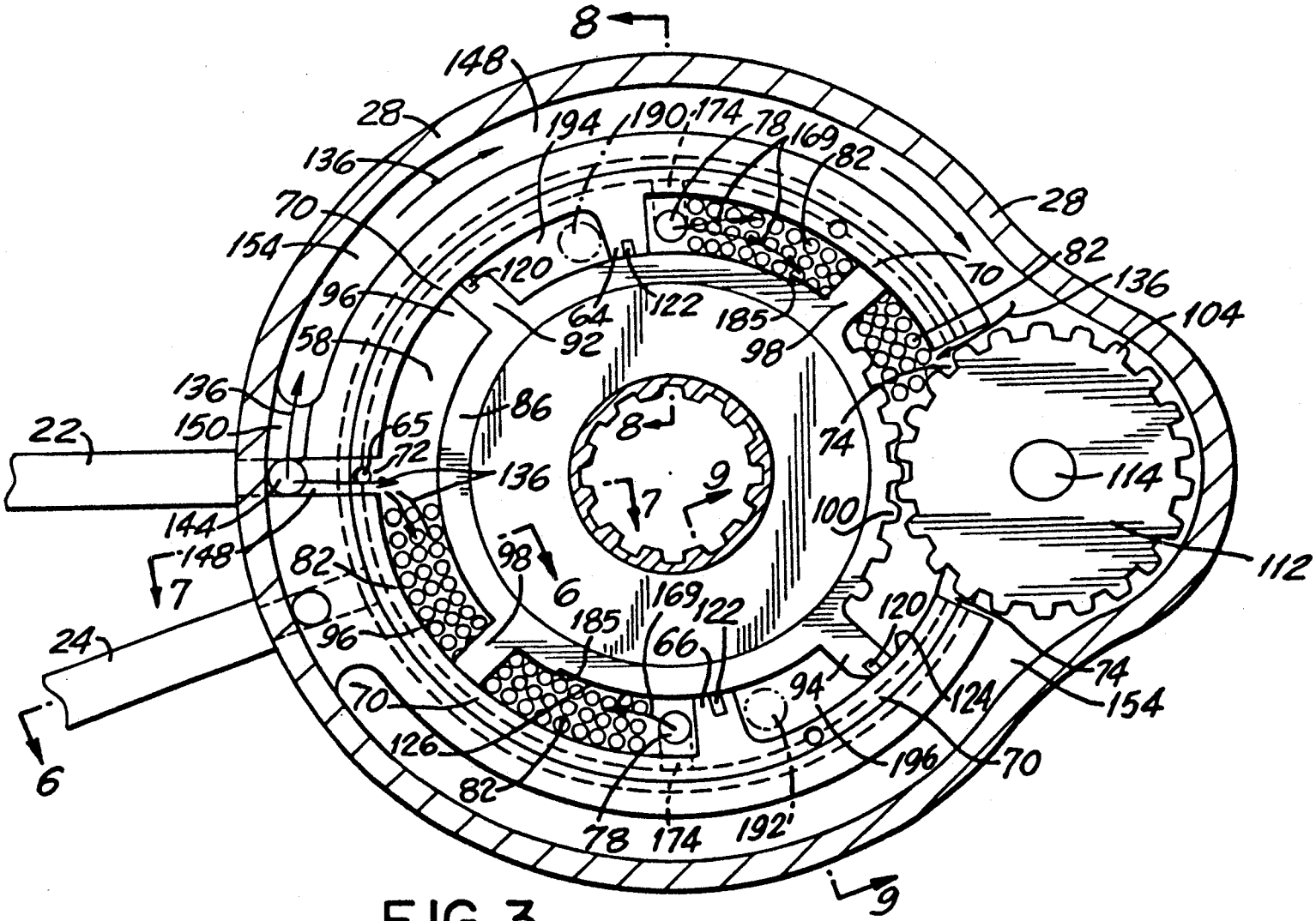
FIG. 3 is a view in radial section taken along line 3—3 of FIG. 2.

As seen in FIG. 3, lower port plate 58 (as well as upper port plate 56, not shown in FIG. 3) is formed with a pair of diametrically opposed., radially inwardly extending ribs 64,66. An axially extending shoulder 70 surrounds most of the outer circumference of each port plate 56,58. A pair of diametrically opposed inlet flow ports 72,74 is formed through diametrically opposed portions of each shoulder 70. At approximately 90° around the circumference of the upper and lower port plates 56,58 from each inlet flow port 72,74, upper and lower discharge flow return ports 76,78 are respectively formed through the port plates.

Between each inlet flow port 72,74 and each respective discharge flow return port 76,78 located counterclockwise therefrom is a circumferentially extending arcuate array of axially directed flow control holes 80,82. As shown in FIG. 3, one array or set of flow control holes 82 extends circumferentially over an arc of about 80°, with the diametrically opposed array 82 also extending over an arc of about 80°. The flow control holes 80,82, which respectively extend completely through each port late 56,68.

Actuation rings 84,86 are shown in FIG. 2 and FIG. 3 to be rotatably seated within an annular recesses 88,90 respectively formed in the upper and lower port plates 56,58. Each actuation ring is provided with a pair of diametrically opposed, radially outwardly extending servo vanes 94. Evenly spaced from each servo vane 94 is a pair of diametrically opposed port divider ribs 98 projecting radially outwardly from the actuation rings 84,86. The actuation rings slide and rub on the respective rotor end plates 52,54.

A generally circular U-shaped channel 96 is defined between each port plate shoulder 70 and the outer circumference of the body of each actuation ring 84,86. This channel is divided into variable selectively sized segments defined between the port plate ribs 64,66, the servo vanes 94 and the port divider ribs 98. As discussed below, as the actuation rings are rotated around the fixed port plates, the size and volume of the various channel shaped segments change so as to vary the pump output. As seen in FIGS. 6 through 10, when channels 96 are closed off by the rotor end plates 52,54, the channels define a rectangular cross section.

Each actuation ring 84,86 is provided with a series of gear teeth 100 for engaging complementary gear teeth 104 formed on a synchronizer 108. As seen in FIG. 2, synchronizer 108 includes upper and lower gear wheels 110,112 which are rigidly fixed to and interconnected by a synchronizer shaft 114. The ends of the synchronizer shaft 114 may be rotatably mounted within upper and lower bearings 116,118 which are respectively mounted within the upper and lower housing members 28,30.

With reference to FIG. 3, seals 120 may be provided between each servo vane 92,94 and the opposed inner wall 124 of each confronting shoulder 70 on each port plate 56,58. Similar seals 122 may be provided between each rib 64,66 of each port plate and the outer wall 126 of each actuation ring 84,86. Additional sealing may be provided as needed by O-rings 106 as seen in FIG. 2.

Figure 5:
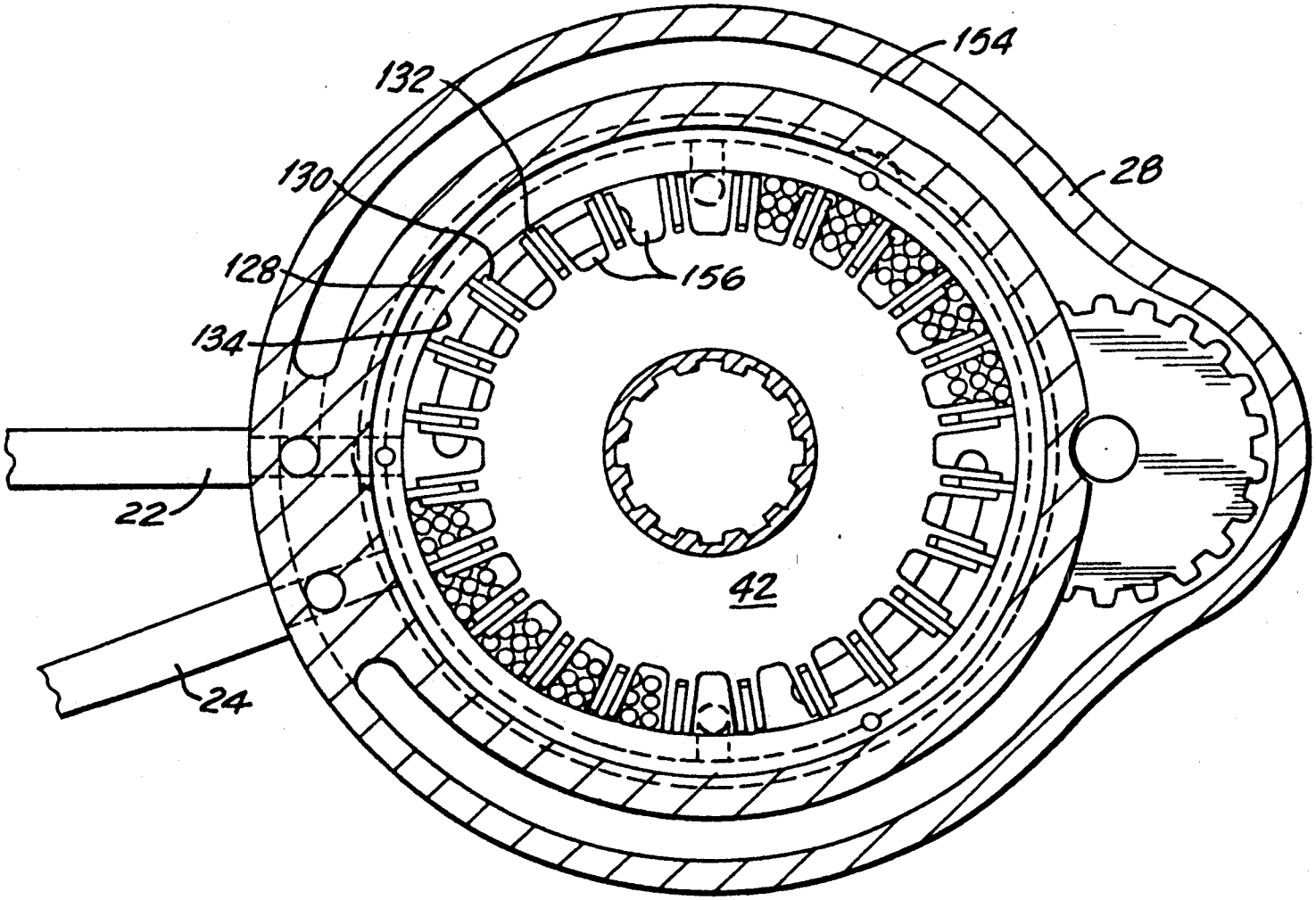
FIG. 5 is a view in radial section taken along line 5—5 of FIG. 2.

An annular cam 128, as shown in FIGS. 2 and 5, is radially fixed in permanent position between the upper housing member 28 and the rotor 42 and is further axially fixed in permanent position between the upper and lower port plates 56,58. The fixed cam 128 is rigidly held in place by the clamping force provided by bolts 32. This clamping force is transmitted through the rotor end plates 52,54, through the port plates 56,58 and into the fixed cam.

The rotor 42 is provided with a circumferentially staggered, spoked array of radially slotted vane supports 130. A radially outwardly biased vane 132 is mounted in a conventional manner within the slot formed in each vane support 130 for resilient sliding engagement against the inner surface 134 of the fixed cam 128.

A general description of the operation of the pump 20 may be best initiated with reference to FIG. 2. Low pressure fluid such as aviation fuel 136 enters inlet 22 and flows into an axial passage or bore 140 formed within the upper housing member 28. Bore 140 splits the low pressure fluid into an upper path 142 and a lower path 144. The low pressure fuel 136 then flows radially inwardly through upper and lower radial bores 146,148 formed in the upper housing member 28 and directly into the inlet flow ports 72 of each port plate 56,58 (FIG. 3).

Figure 7:
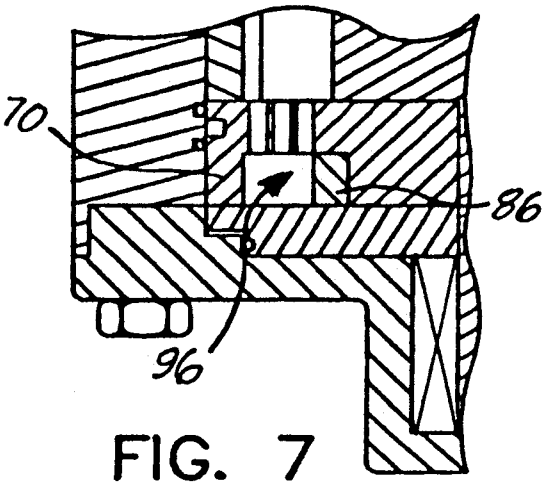
FIG. 7 is a partial view in axial section taken along line 7—7 of FIG. 3.

As further seen in FIG. 3, additional low pressure fuel 136 travels circumferentially clockwise from a point adjacent the entrance to radial bores 146,148 through upper and lower circumferential channels 150 formed in the upper housing member 28. This low pressure fuel 136 then travels clockwise around and through the upper housing member 28 via arcuate flow channel 154 formed therein. As seen in FIG. 7, flow channel 154 does not extend completely around the upper housing but is blocked between the inlet 22 and outlet 24.

Low pressure fuel 136 travelling along flow channel 154 then enters the other inlet flow ports 74 at a point about 180° from the inlet flow ports 72. ,As seen in FIG. 2, with respect to fuel flowing through inlet flow ports 72, the low pressure fuel 136 travels axially and inwardly under the positive pressure created by an external boost pump located in the fuel system and through the upper and lower port plates 56,58 via the flow control holes 80,82. The same fuel flow takes place with respect to low pressure fuel flowing through inlet flow ports 74.

After passing axially through the diametrically opposed sets of flow control holes 80,82, the low pressure fuel 136 enters the vane cavities 156, as seen in FIG. 2. It is seen in FIGS. 2 and 5 that each vane cavity 156 is defined between each pair of adjacent vane supports 130 and the associated adjacent pair of vanes 132, the inner surface 134 of the fixed cam 128 and the inner radial surfaces 158,160 of the upper and lower port plates 56,68. Upon entering the vane cavities 156, the low pressure fuel 136 is pressurized by the rotating vanes as the vane cavities decrease in volume and force the fuel through a pair of diametrically opposed high pressure discharge ports 162,164 (FIG. 4) formed in each upper and lower port plate 56,68.

Figure 4:
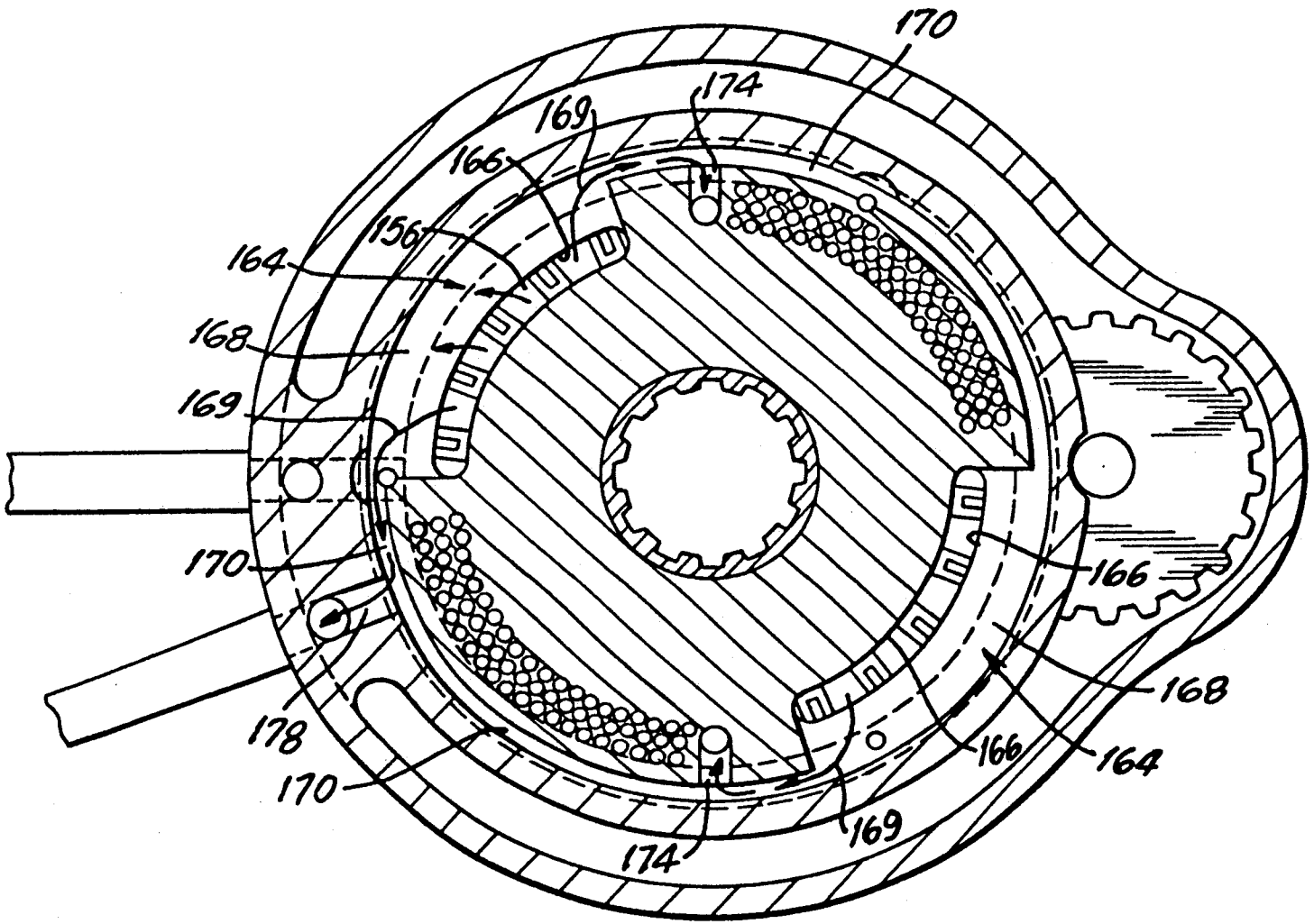
FIG. 4 is a view in radial section taken along line 4—4 of FIG. 2.

As seen in FIGS. 2 and 4, each high pressure discharge port 162,164 includes a relatively narrow arcuate slot 166 which leads axially outwardly from the axial end portions of each vane cavity 156 into a radially outwardly extending arcuate discharge slot 168. High pressure fuel 169 exits each discharge slot 168 and flows circumferentially around the outer diameter of each port plate via high pressure annular grooves 170 formed therein.

Figure 8:
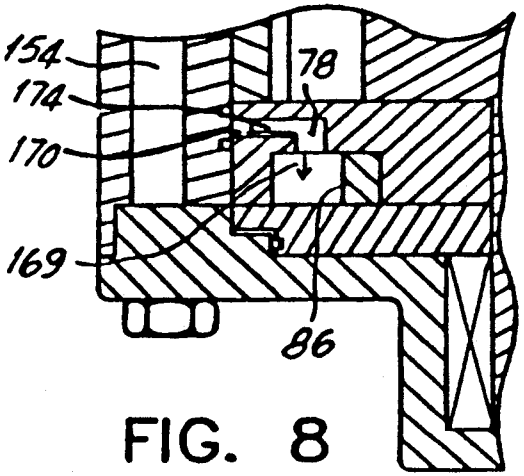
FIG. 8 is a partial view in axial section taken along line 8—8 of FIG. 3.

As further seen in FIGS. 2, 4 and 8, each high pressure groove 170 directs high pressure fuel to a pair of diametrically opposed radial slots 172,174 formed in each port plate. An axially outwardly extending bore which defines the aforementioned discharge flow return ports 76,78 leads from each radial slot 172,174 through each port plate as seen in FIGS. 2, 3 and 8.

At this point, the high pressure fuel 169 flows circumferentially over those flow control holes 80,82 which are located between the radially inwardly extending ribs 64,66 provided on each port plate and the radially outwardly extending movable port divider ribs 98 provided on the actuation rings 84,86. The high pressure fuel will then re-enter the vane cavities 156, as seen in FIGS. 2 and 5, to begin the flow cycle again. The pressure of the high pressure fuel entering vane cavities 156 is essentially equal to the pump discharge pressure so a driving "motor" torque is developed.

Figure 6:
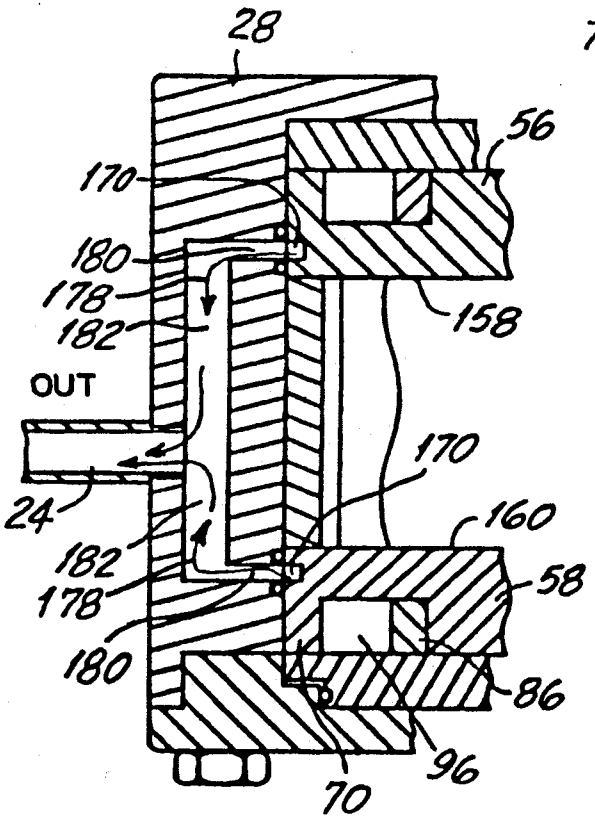
FIG. 6 is a partial view in axial section taken along line 6—6 of FIG. 3 showing the pump discharge outlet.

Not all of the high pressure fuel 169 is necessarily returned to the vane cavities 156. As seen in FIGS. 4 and 6, a portion 178 of the high pressure fuel 169 is typically directed via high pressure groove 170 to a pair of radially extending outlet slots 180 formed in the upper housing member 28. Outlet slots 180 communicate with an axially extending outlet bore 182 which directs high pressure fuel or any other suitable fluid through outlet 24 for use in an aircraft engine, fluid actuator or the like.

The discharge flow 178 through outlet 24 may be controlled by rotating the actuation rings 84,86 so that the relative amounts of low pressure fluid and high pressure fluid entering the vane cavities 156 may be controllably apportioned and varied. As seen in FIG. 3, if each actuation ring 84,86 is rotated clockwise, more of the high pressure fuel 169 will gain access to the vane cavities 156 via flow control holes 82. At the same time, less low pressure fuel 136 will be allowed access to the flow control holes 82 as the low pressure fuel is blocked by the port divider ribs 98.

In the position shown in FIG. 3, the actuation ring is positioned such that the port divider ribs 98 equally divide and equally apportion the high pressure fuel 169 and low pressure fuel 136 into the flow control holes 82. In this case, the output of the pump 20 is approximately one-half of its full output. Further clockwise rotation of the actuation rings will further decrease the output of the pump while counterclockwise rotation of the actuation rings will increase the output of the pump. Counterclockwise rotation of the actuation rings as viewed in FIG. 3 is limited by the provision of radial shoulders 185 formed on the actuation rings 84,86.

Figure 9:
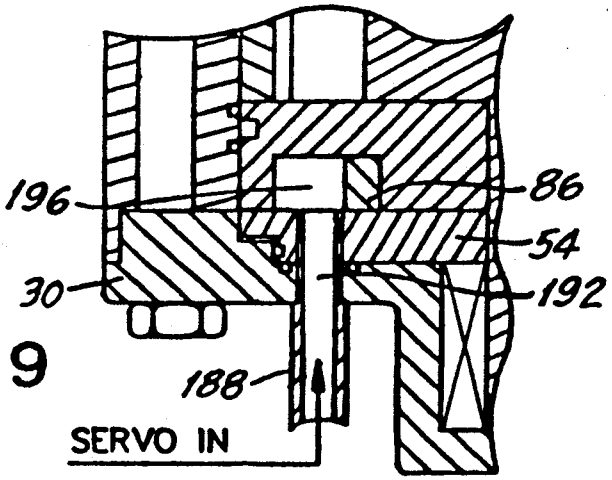
FIG. 9 is a partial view in axial section taken along line 9—9 of FIG. 3.

Rotation of the actuation rings 84,86 may be controlled by the metered application of a servo pressure to the servo vanes 92,94. As shown in FIGS. 1, 3 and 9, a pair of servo pressure inlet tubes 186,188 communicates with a pair of diametrically opposed axial bores 190,192 formed through the lower housing member 30 and through the lower rotor end plate 54. Axial bores 190,192 channel pressurized servo fluid into a pair of variable volume arcuate chambers 194,196 defined between the stationary, radially inwardly extending ribs 64,66 formed on the port plates 56,58 and the movable servo vanes 92,94 formed on the actuation rings 84,86.

As the servo fluid pressure is increased in FIG. 3, the actuation ring 86 will rotate counterclockwise thereby increasing the pump output delivery by allowing more low pressure fuel 136 to enter the vane cavities 156 and by allowing less high pressure fuel 169 to be returned to the vane cavities. This rotation of the upper and lower actuation rings is coordinated and synchronized by the synchronizer 108. That is, actuation of the lower actuation ring 86 causes the lower gear wheel 112 to rotate. This same rotation is transmitted to the upper gear wheel 110 and upper actuation ring 84 via shaft 114.

Since the cam 128 does not move, it may be employed to separate and space the port plates 54,56 as in conventional vane pump designs. This is an economical design simplification as compared to comparable movable cam designs. Moreover, the present invention has less potential leakage paths than in comparable movable cam designs since movable cams require a clearance between the cam and port plates. Finally, the servo fluid actuation forces of the present invention are less than those associated with conventional movable cam designs.

There has been disclosed heretofore the best embodiment of the invention presently contemplated. However, it is to be understood that various changes and modifications may be made thereto without departing from the spirit of the invention.

What is claimed is:

1. A variable delivery vane pump, comprising:

a housing;

a rotor mounted within said housing;

a plurality of vanes provided on said rotor;

cam means permanently fixed in a predetermined position within said housing and cooperating with said vanes to define a plurality of vane cavities;

inlet means provided in said housing for introducing fluid into said vane cavities;

outlet means provided in said housing for discharging fluid from said vane cavities; and apportioning means communicating with said inlet means and said outlet means for selectively channeling fluid from said outlet means into said inlet means so as to controllably vary delivery of fluid from said pump, wherein said apportioning means apportions communication of said flow control holes between said inlet means and said outlet means;

a port plate having a plurality of flow control holes formed therein for directing fluid therethrough, wherein said port plate comprises a pair of radial ribs and wherein said actuation ring comprises a pair of port divider ribs moveably aligned over said flow control plates.

2. The pump of claim 1, wherein said port plate is formed with an annular channel and wherein said radial ribs project into said annular channel.

3. The pump of claim 2, wherein said port divider ribs radially project into said annular channel.

4. The pump of claim 3, wherein said actuation ring further comprises a pair of servo vanes projecting into said channel.

5. The pump of claim 4, wherein each of said radial ribs is respectively disposed between one of said port divider ribs and one of said servo vanes so as to divide said channel into a plurality of channel segments.

6. The pump of claim 5, wherein fluid from said inlet means is directed into at least one of said channel segments defined between one of said servo vanes and one of said port divider ribs.

7. The pump of claim 5, wherein fluid from said outlet means is directed into at least one of said channel segments defined between one of said port dividers and one of said radial ribs.

8. The pump of claim 7, further comprising servo means for actuating said actuation ring with a servo fluid and wherein said servo fluid is directed into at least one of said channel segments defined between one of said radial ribs and one of said servo vanes.

* * * * *